US007082751B2

(12) United States Patent
McCulloch

(10) Patent No.: US 7,082,751 B2
(45) Date of Patent: Aug. 1, 2006

(54) GAS COMPRESSOR POLLUTION CONTROL SYSTEM AND METHOD

(76) Inventor: Allen W. McCulloch, 2651 Farmington Ave., Farmington, NM (US) 87401

( * ) Notice: Subject to any disclaimer, the term of this patent is extended or adjusted under 35 U.S.C. 154(b) by 0 days.

(21) Appl. No.: 10/827,587

(22) Filed: Apr. 19, 2004

(65) Prior Publication Data

US 2005/0229591 A1 Oct. 20, 2005

(51) Int. Cl.
*F01N 3/00* (2006.01)

(52) U.S. Cl. ..... 60/274; 60/280; 60/307; 417/364

(58) Field of Classification Search ..... 60/274, 60/280, 299, 307, 39.45; 417/364
See application file for complete search history.

(56) References Cited

U.S. PATENT DOCUMENTS

| | | | | | |
|---|---|---|---|---|---|
| 2,909,904 | A | * | 10/1959 | Hasche | 62/600 |
| 3,579,308 | A | * | 5/1971 | Sennewald et al. | 422/112 |
| 4,437,813 | A | * | 3/1984 | Ingram | 417/53 |
| 4,961,691 | A | | 10/1990 | Waldrop | |
| 5,203,311 | A | * | 4/1993 | Hitomi et al. | 60/605.2 |
| 5,203,680 | A | | 4/1993 | Waldrop | |
| 5,378,113 | A | | 1/1995 | Caldwell | |
| 5,433,180 | A | * | 7/1995 | Hitomi et al. | 123/311 |
| 5,458,855 | A | * | 10/1995 | Gillbrand | 422/168 |
| 5,485,674 | A | | 1/1996 | Caldwell | |
| 5,509,394 | A | * | 4/1996 | Hitomi et al. | 123/559.1 |
| 5,845,492 | A | * | 12/1998 | Isobe et al. | 60/284 |
| 5,937,831 | A | * | 8/1999 | Volkmann et al. | 123/559.3 |
| 5,974,792 | A | * | 11/1999 | Isobe | 60/278 |
| 6,227,180 | B1 | * | 5/2001 | Hoffmann et al. | 123/564 |
| 6,327,856 | B1 | * | 12/2001 | Iwabuchi et al. | 60/603 |
| 6,354,318 | B1 | * | 3/2002 | Butler | 137/2 |
| 6,626,646 | B1 | | 9/2003 | Rajewski | |
| 6,644,334 | B1 | * | 11/2003 | Briggeman | 137/13 |
| 2004/0103644 | A1 | * | 6/2004 | Sabelstrom et al. | 60/280 |

FOREIGN PATENT DOCUMENTS

| | | | |
|---|---|---|---|
| JP | 05-086989 | * | 4/1993 |
| JP | 05-187329 | * | 7/1993 |
| JP | 10-274064 | * | 10/1998 |
| WO | WO 00/66251 A1 | | 11/2000 |

OTHER PUBLICATIONS

U.S. Patent Office International Searching Authority, Patent Cooperation Treaty, "Notification of Transmittal of The International Search Report and The Written Opinion of the International Searching Authority, or the Declaration—International Search Report," Dec. 6, 2005, 7 pages.

* cited by examiner

*Primary Examiner*—Thomas Denion
*Assistant Examiner*—Diem Tran
(74) *Attorney, Agent, or Firm*—Haynes and Boone, LLP

(57) ABSTRACT

A pollution control system and method for a compressor for compressing gas, according to which a combustion engine is connected to the compressor for driving the compressor, and the products of combustion from the engine are passed into the flow line connecting the source of the gas to the compressor.

11 Claims, 1 Drawing Sheet

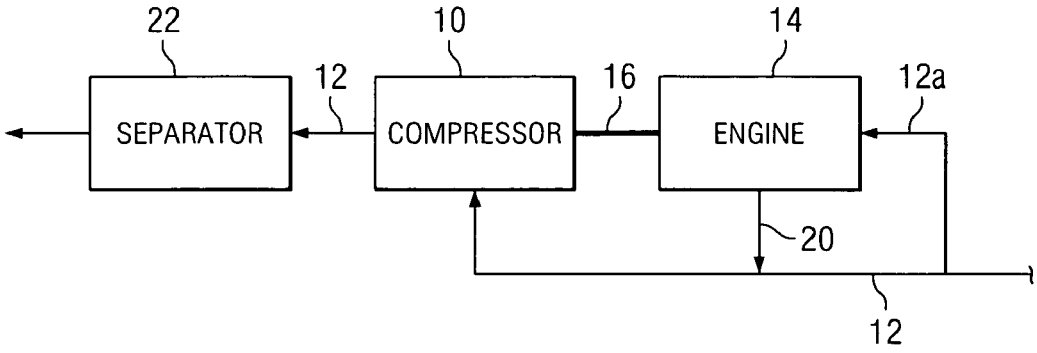
22
10
14
12
16
12a
SEPARATOR
COMPRESSOR
ENGINE
20
12

GAS COMPRESSOR POLLUTION CONTROL SYSTEM AND METHOD

BACKGROUND

This invention relates to a pollution control system and method for a gas compressor driven by an internal combustion engine.

Gas compressors are used in the oil and gas industry to increase the fluid pressure in the flow lines for the oils and gases. Many of these compressors are driven by internal combustion engines which are often powered by natural gas.

However, the exhaust, or flue, gases from the engine are usually vented to atmosphere causing excessive noise and particulate pollution. Also, since the combustion process is less than completely efficient, unspent fuel from the engine is also vented to atmosphere.

Therefore, what is needed is a system for reducing this type of pollution and recover the unspent fuel.

BRIEF DESCRIPTION OF THE DRAWINGS

The drawing is a diagrammatic view of an embodiment of the invention.

DETAILED DESCRIPTION

Referring to FIG. 1 of the drawings, the reference 10 refers, in general to a natural gas compressor connected in a main flow line 12 consisting of one or more pipes, conduits, risers, etc. The compressor 10 can be of any conventional type, such as a screw type, a rotary type, or the like.

It is understood that the flow line 12 extends from a gas well (not shown) and that gases recovered from the well pass in the flow line in the direction indicated by the flow arrows. The gases thus flow from the well, through the flow line 12, and to the compressor 10, which functions to compress the gases. The compressed gases then pass from the compressor 10 through the flow line 12 for some downstream treatment that will be described, before the gases pass to their ultimate destination.

The compressor 10 is driven by an internal combustion engine 14 in a manner to be described, and a branch line 12*a* extends from the flow line 12 upstream of the compressor 10 to the engine to pass a portion of the gases flowing in the flow line to the engine for powering the engine in a conventional manner. The engine 14 is conventional and, as such, generates products of combustion including exhaust, or flue gases. Also, since the combustion process in the engine 14 is less than completely efficient, unspent fuel, primarily in the form of hydrocarbons, is also present in the exhaust.

The engine 14 is connected by a drive shaft 16 to the compressor 10 so that, when activated, the engine 14 drives the compressor 10 in a conventional manner. The engine 14 has an inlet for receiving the gases from the branch line 12*a* which serve as fuel to power the engine, and an outlet for discharging the products of combustion and the unspent fuel. A pipe, or conduit, 20 connects the outlet of the engine 14 to the flow line 12 upstream of the compressor 10 and downstream from the branch line 12*a*. The pipe 20 passes the above products of combustion and any unspent fuel from the engine 14 to the flow line 12 where they are mixed with the well gases flowing through the flow line. The mixture thus passes into the compressor 10 and is compressed before the compressed mixture exits the compressor via the flow line 12.

The compressed mixture exiting from the compressor via the flow line 12 can be treated prior to being routed to its ultimate destination, or end user. For example, the H20, C02 and/or nitrogen from the products of combustion, and/or the unspent fuel in the mixture can be separated from the remaining portion of the mixture, such as by resin reabsorption, or the like and thus recaptured for reuse or disposal. This can be done in any conventional manner and at any convenient location, such as by a separator 22 connected to the output of the compressor 10, at the ultimate destination, or at a gas processing plant, a cryogenic plant, or the like, located between the compressor and the ultimate destination.

Thus, the products of combustion from the engine 14 are not discharged into the atmosphere, but rather are mixed with the well gases being processed, thus avoiding any noise or particle pollution of the atmosphere. Also, the products of combustion can be separated from the mixture before the mixture is passed to the end user. Further, the unspent fuel, primarily in the form of hydrocarbons, from the engine 14 is not wasted, but rather is added to the product gases in the line 12 for use by the end user.

It is understood that variations may be made in the foregoing without departing from the scope of the invention. For example, the particular designs of the compressor 10 and the engine 14 can be varied. Also, the engine 14 can be powered by fuel, such as diesel or gasoline, from a source other than the line 12. Further, the branch line 12*a* and the pipe, or conduit, 20 can be connected to the line 12 at locations that are different from those shown in the drawings. Still further, the products of combustion from the engine 14 can be separated from the remaining portion of the above mixture before the mixture is compressed. Moreover, the terms "flow line", "branch line", "pipe", "riser", and "conduit" have been used interchangeably, and it is understood that all refer, in general, to any device that permits the flow of fluid therethrough.

Although only one exemplary embodiment has been described in detail above, those skilled in the art will readily appreciate that many other variations and modifications are possible in the exemplary embodiment described above without materially departing from the novel teachings and advantages of this invention. Accordingly, all such variations and modifications are intended to be included within the scope of this invention as defined in the following claims. In the claims, means-plus-function clauses are intended to cover the structures described herein as performing the recited function and not only structural equivalents, but also equivalent structures.

What is claimed is:

1. A pollution control system comprising:

a compressor;

a first flow line connected between a well and the compressor for supplying natural gas from the well to the compressor;

a combustion engine connected to the compressor for driving same;

a second flow line connected between the first flow line and the engine for supplying a portion of the natural gas to the engine to power the engine;

a third flow line connecting the engine to the first flow line downstream of the connection of the second flow line to the first flow line so that the exhaust from the engine mixes with the natural gas in the first flow line before the mixture enters the compressor for compression;

a separator connected to the compressor for receiving the compressed mixture from the compressor and separating the exhaust from the natural gas; and means for passing the separated natural gas to a destination.

2. The system of claim 1 wherein the third flow line is connected to the first flow line upstream of the connection of the first flow line to the compressor.

3. The system of claim 1 wherein the exhaust includes unspent hydrocarbons.

4. The system of claim 1 wherein the exhaust includes at least one of water, carbon dioxide, and nitrogen.

5. The system of claim 1 wherein the separating means separates the exhaust from the natural gas by resin re-absorption.

6. A pollution control method comprising:

connecting a first flow line between a gas well and a compressor for supplying natural gas from the well to the compressor;

connecting a second flow line from the first flow line to a combustion engine for supplying a portion of the natural gas to the engine to power the engine;

driving the compressor by the engine;

passing the products of combustion and the unspent fuel from the engine to the first flow line downstream of the connection of the second flow line to the first flow line so that the exhaust from the engine mixes with the natural gas in the first flow line before the mixture enters the compressor;

compressing the mixture in the compressor;

passing the compressed mixture to a separator;

separating the exhaust from the natural gas in the separator; and passing the separated natural gas to a destination.

7. The method of claim 6 wherein the products of combustion and the spent fuel from the engine are passed to the first flow line upstream of the connection of the first flow line to the compressor.

8. The method of claim 6 wherein the exhaust includes unspent hydrocarbons.

9. The method of claim 6 wherein the step of separating is by resin re-absorption.

10. The method of claim 6 wherein the exhaust includes at least one of water, carbon dioxide, and nitrogen.

11. The method of claim 10 further comprising reusing the separated water, carbon dioxide, and nitrogen.

* * * * *